US005177321A

United States Patent [19]

Kenny

[11] Patent Number: 5,177,321

[45] Date of Patent: Jan. 5, 1993

[54] APPARATUS FOR SEVERING TUBULAR MEMBERS

[76] Inventor: John J. Kenny, 5977 General Haig, New Orleans, La. 70124

[21] Appl. No.: 733,994

[22] Filed: Jul. 22, 1991

Related U.S. Application Data

[62] Division of Ser. No. 574,207, Aug. 28, 1990, Pat. No. 5,031,540.

[51] Int. Cl.[5] ..... F42B 3/00; E21B 43/117

[52] U.S. Cl. ..... 102/312; 102/313; 166/55; 166/299; 175/4.51

[58] Field of Search ..... 102/312, 313; 175/4.51, 175/4.52; 166/299, 361, 55

[56] References Cited

U.S. PATENT DOCUMENTS

| | | | |
|---|---|---|---|
| 3,958,639 | 5/1976 | Daniel | 166/294 |
| 4,181,196 | 1/1980 | Darby et al. | 166/361 |
| 4,662,451 | 5/1987 | Boade | 166/299 |
| 4,683,943 | 8/1987 | Hill et al. | 11/11 X |
| 4,756,371 | 7/1988 | Brieger | 175/4.51 X |
| 5,031,940 | 7/1991 | Kenny | 166/299 X |

*Primary Examiner*—Peter A. Nelson
*Attorney, Agent, or Firm*—Keaty & Keaty

[57] ABSTRACT

The invention relates to an apparatus for severing tubular members and is provided with a carrier, which carries a sparging assembly and an explosive assembly downwardly into the tubular member to be severed. The outlet of the sparging assembly is below the lower end of the carrier and is at a level adjacent to the level of the explosive charge carried by the explosive assembly. The sparging assembly dislodges and agitates the debris accumulated within the tubular member and evacuates it from the level, wherein it is deployed, simultaneously allowing progression of the explosive assembly downward along the interior of the tubular member.

18 Claims, 2 Drawing Sheets

APPARATUS FOR SEVERING TUBULAR MEMBERS

This is a continuation of application Ser. No. 574,207, filed Aug. 28, 1990, and now U.S. Pat. No. 5,031,540.

BACKGROUND OF THE INVENTION

The present invention relates to an apparatus for explosive severing of tubular members and more specifically to an apparatus for severing tubular members below a body of water, such as for example an offshore rig platform pile.

During offshore drilling and production operations, it becomes necessary to move a platform to a different location or to permanently move the platform away from that particular sea area.

Since an offshore platform is oftentimes supported by a number of piles which extend from the platform downwardly through the body of water and below a mud line, there exists a problem of removing those piles or at least part of the piles, so as to allow unencumbered navigation in the area where the platform has been deployed.

The current environmental protection laws require that the piles which have supported the platform be severed at least 15 feet below the mud line.

As is often the case, the pile becomes clogged with mud if any substantial period of time has passed since the platform was removed until the time when the pile is eventually severed and removed. The mud from the pile has to be evacuated before the explosive device can be positioned inside the pile at a predetermined depth for severing the pile and removing the severed part from the bottom of the ocean.

The traditionally used method utilizes a sparqing apparatus which is used for delivery of air and water under pressure from an equipment positioned on a barge at the location, wherein the piles need to be removed. The sparging apparatus is lowered by a crane positioned on the barge into the open top end of the pile and the air and water are introduced, under pressure, into the sparging nozzle, so as to break the mud and force it outwardly from the pile to prepare the space for deployment of an explosive pile severing device. As the practice showed, the mud which has been agitated by the sparging apparatus is mostly evacuated from the pile, with still an unacceptable amount of it falling back into the pile and further intervening with the mud evacuation process. As a result, considerable time is lost for evacuation of the mud to a depth wherein the explosive device must be positioned within the pile. Additional drawback is associated with the fact that the sparging device, being lowered in the water, has to be positioned with precision to enter the narrow open top of the pile, which causes sometimes damage to the sparging device, which in turn translates into the loss of valuable time.

The present invention contemplates elimination of the drawbacks associated with the prior art and provision of the explosive device for severing tubular members, such as underwater piles, which have been filled with mud or silt.

SUMMARY OF THE INVENTION

It is therefore an object of the present invention to provide an apparatus for severing tubular members under water.

It is a further object of the present invention to provide an explosive apparatus which utilizes sparging assembly to facilitate positioning of the explosive device at a required depth.

It is still a further object of the present invention to provide an apparatus for severing tubular members which is easy to position within the open top end of an underwater pile.

It is still a further object of the present invention to provide an apparatus for severing tubular members, wherein at least part of the underwater equipment is retrievable.

These and other objects of the present invention will be apparent to those skilled in the art from the following description of the invention. The objectives of the present invention are achieved by provision of an apparatus for severing tubular members which comprises a cylindrical carrier having a central opening therethrough, a sparging assembly for removinq the debris accumulated within said tubular member and an explosive assembly detachably mounted on the carrier adjacent a lower portion of the carrier for explosively severing the tubular member. The explosive assembly has an annular frame with a central opening which is co-alignment with the central opening of the cylindrical carrier and receives a lower portion of the sparging assembly therethrough. The frame of the explosive assembly carries an explosive charge at a level adjacent a bottom part of the sparging assembly. An upper part of the sparging assembly extends above the top edge of the carrier, with one of the conduits of the sparging assembly being in fluid communication with above-the-surface equipment for delivering of pressurized water through the conduit into the tubular member for dislodging the debris within the tubular member.

The second conduit of the sparging assembly serves as the debris evacuation conduit with an evacuation inlet being adjacent the outlet of the water delivering conduit and the evacuation conduit outlet-above the upper edge of the carrier. The outlet of the evacuation conduit is oriented downwardly, so that at least a part of the debris which was evacuated from the level of the explosive assembly is allowed to settle on the top of the explosive assembly and provide a downwardly directed component to assist in downward movement of the apparatus within the tubular member to be .severed. A pressure differential is created within the debris evacuation conduit to facilitate removal of the agitated debris from the level of agitation to the level above the upper end of the carrier.

The explosive assembly is suspended by compression means from the lower end of the carrier, the compression means moving between a first expanded position, supporting the carrier and a second, retracted position, releasing the explosive assembly and allowing a retrieval of the sparging assembly and the cylindrical carrier which is securedly attached to the sparging assembly.

BRIEF DESCRIPTION OF THE DRAWINGS

Reference will now be made to the drawings, wherein like parts are designated by like reference numerals, and wherein.

DETAIL DESCRIPTION OF THE PREFERRED EMBODIMENT

Figure 1:
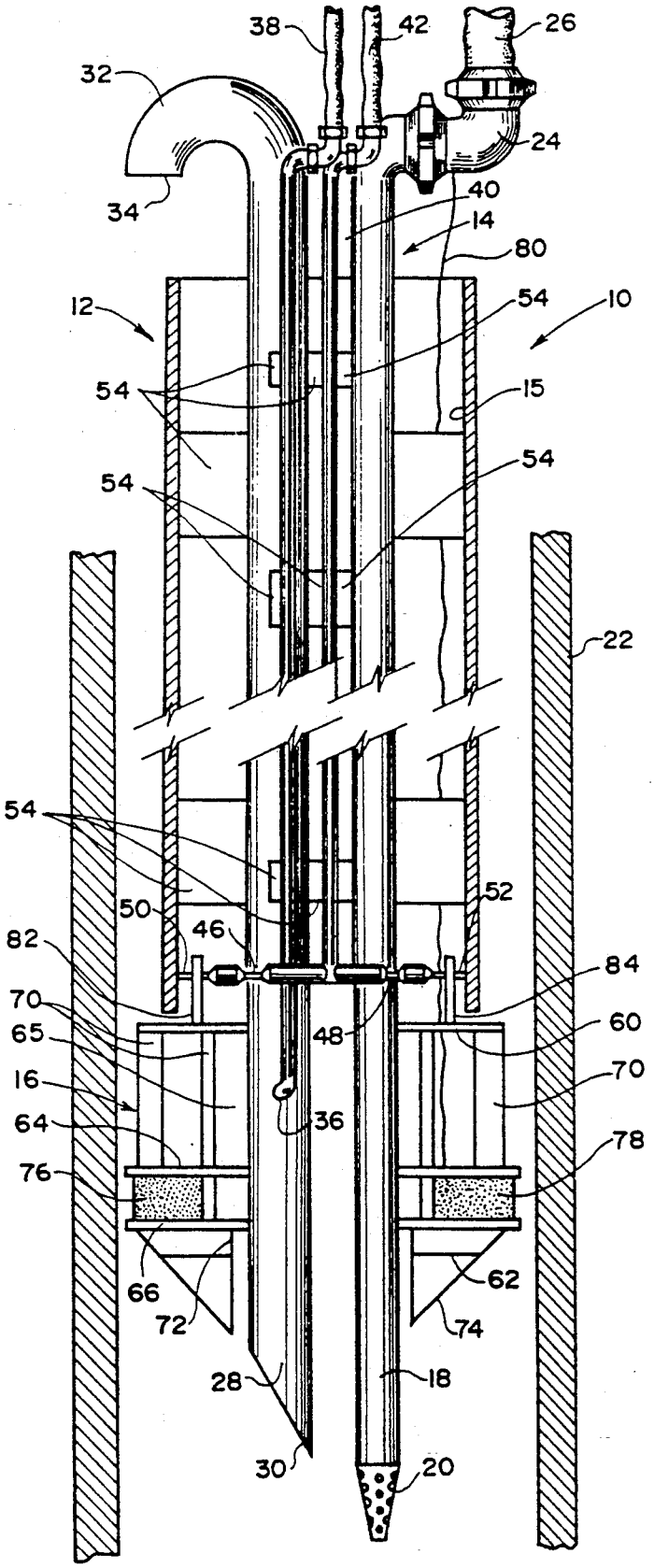
FIG. 1 is a perspective, partially cutaway view of the apparatus of the present invention positioned within a tubular member.
Figure 2:
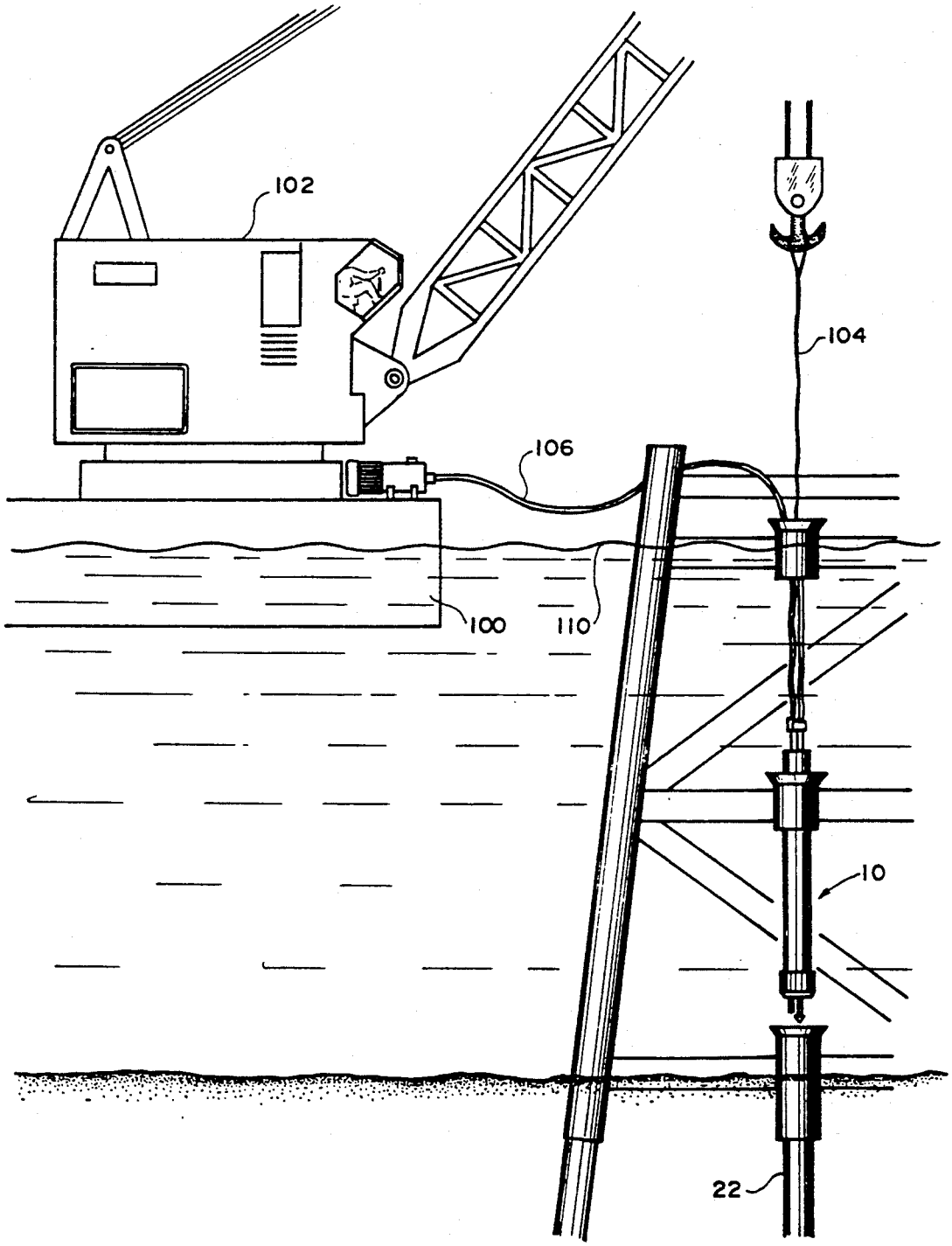
FIG. 2 is a perspective schematic view of the apparatus of the present invention being lowered from a floating barge into the pile to be severed.

Referring now to the drawings in more detail, the apparatus of the present invention is seen to be designated by numeral 10. The apparatus 10 comprises a carrier 12, a sparging assembly 14 and an explosive assembly 16. The carrier 12 comprises a hollow tubular body which supports and carries a sparging assembly 14 therein. The carrier 12 also carries, by the lower portion thereof, the explosive assembly 16 in a releasable engagement therewith.

The sparging assembly 14 comprises a sparging conduit 18 which is provided with a sparging nozzle 20 at the lowermost end thereof. The sparging nozzle 20 has a generally conical shape and is formed with a plurality of openings which are in fluid communication with the central opening of the sparging conduit 18 and which are adapted to allow exit of water and air under pressure into the pile 24 which has to be severed.

The opposite end of the sparging conduit 18 is provided with a swivel assembly 24 which allows a limited swivel movement of the conduit 18, so as to assist in positioning of the apparatus 10 within the pile 22. The swivel assembly 24 can swivel up to 180 degrees, if required, allowing considerable flexibility in movement to the apparatus 10 under water. The distant end of the swivel assembly 24 is connected to a flexible water supply conduit 26 which, in turn, is connected to a pressurization means for pumping water under pressure through the sparging conduit 18 to facilitate sparging of the mud or silt accumulated within the pile 22.

Extending in substantially parallel relationship to the sparging conduit 18 is a mud evacuation conduit 28, the bottom end 30 of which extends to a level adjacent the sparging nozzle 20, while the top end of which is open and extends above the top of the carrier 12. The top end 32 of the mud evacuation conduit 28 is curved, with an opening 34 facing downwardly, the reasons of which will be explained in more detail hereinafter. The bottom end 30 of the conduit 28 is cut at an angle, so as to facilitate alignment of the apparatus 10 with the open top to the pile 22.

Extending within the conduit 28 is an air line conduit 36 which delivers air from the surface through a flexible air supply hose 38. The air under pressure is delivered into the central opening of the mud evacuation conduit 28 and creates a partial vacuum within the mud evacuation conduit 28 and facilitates upward movement of the agitated mud and water through the conduit 28, causing a partial "suction" action within the conduit 28 and delivery of the mud and exhaust of it through the open end 34 of the conduit 28.

A second air line conduit 40 is secured and supported within the carrier 12 and is connected to a source of pressurized air on the surface, delivering the pressurized air to pneumatic securing pins 46 and 48 which retain the explosive assembly 16 in releasably securably position in relation to the carrier 12. The air under pressure which is delivered from a flexible hose 42 into the conduit 40 from the surface, causes the pneumatic pins 46 and 48 to move outwardly. The pneumatic pins 46 and 48 are each provided with securing rods 50 and 52, respectively, which extend in co-alignment with the pneumatic securing pins 46 and 48 and generally transversely to a longitudinal axis of the carrier 12.

The securing rods 50 and 52 frictionally contact the interior wall 15 of the carrier 12, retaining the pneumatic pins 46 and 48 in a temporarily attached relationship to the carrier 12. When the air supply through the hose 42 and the conduit 40 is interrupted, the pneumatic pins 46 and 48, no longer forced outwardly, will move instead inwardly, towards the center of the carrier 12, disengaging the rods 50 and 52 from their engagement with the wall 15.

The sparging conduit 18, mud evacuation conduit 28, as well as the first and second air line conduits 36 and 40 are secured within the carrier 12 by a plurality of gusset plates 54 or by other suitable attachment means.

Suspended on the rods 50 and 52 is the explosive assembly 16.

The explosive assembly utilized in the preferred embodiment of the present invention can be of the type disclosed in my U.S. Pat. No. 4,787,315 the disclosure of which is incorporated by reference herein, or by other explosive device which creates a charge to allow severing of the tubular member about substantially its circumference.

The explosive assembly 16 illustrated in FIG. 1 comprises a top compression plate 60 and a lower compression plate 62, both of which are ring-shaped, leaving a central opening 65 which extends from the bottom of the explosive assembly 16 to the upper part thereof. Each compression plate 60 and 62 is provided with a corresponding deflection plate 64 and 66, respectively. The plates 60 and 64 are secured in a generally parallel relationship to each other by a plurality of elongated spacer bars 70 which are fixedly attached substantially equidistantly at the peripheral edges of plates 60 and 64. The compression plate 62 is secured in parallel relationship with the deflection plate 66 by a straight spacer bar 72 on the interior thereof and by an angular elongated bar 74 between the outermost edge of the plate 66 and the bottom end of the bar 72. As a result, the lower portion of the explosive assembly 16 is generally conically-shaped, with an angle of inclination of the bar 74 coinciding with the angular bottom end of the mud evacuation conduit 28.

In this manner, positioning of the apparatus 10 in relation to the pile 22 is further facilitated, making it easier to lower the bottom of the apparatus 10 into the top of the pile 22 and guide it to the interior of the pile 22.

A ring-shaped sleeve 76 is positioned between the deflection plates 64 and 66 adjacent the inner edges thereof. Thereby an annular space 78 is formed between the exterior of the annular sleeve 76 and the outer limits of the deflection plates 64 and 66. The space 78 is filled with an explosive material which is wrapped or otherwise deposited around the sleeve 24. The explosive charge is detonated by a signal delivered through a detonating cord 80 connected to a control device positioned on the barge. The detonation can be accomplished by delivering the signal to a plurality of circumferentially spaced locations within the explosive charge positioned in the space 78, so as to cause detonation of the explosive charge at a plurality of locations at substantially the same time and cause severing of the tubular member substantially about its circumference, as required.

Extending from the top surface of the top compression plate 60 and fixedly attached thereto are a pair of suspension plates 82 and 84. The plates 82 an 84 are formed with openings adjacent their upper ends of the size and shape suitable to receive the securing rods 50 and 52 therethrough, so as to suspend the explosive assembly 16 from the pneumatic pins 46 and 48.

In operation, a barge 100 is transported to a location, wherein a platform was deployed. A crane 102 has a flexible line 104 on which the apparatus 10 of the present invention is suspended. The necessary air and water hoses are connected to the suitable equipment on the barge 100 and to the respective receiving ends of the apparatus 10. The suspended apparatus 10 is lowered below the water line 110 till the lowermost end of it reaches the entrance to the open end of the pile 22 and is manipulated till it moves downwardly, so that the sparging nozzle 20 enters the pile 22 The water under pressure is then forced through the openings in the sparging nozzle 20, agitating the mud and mixing it with water to fluidize it and make it suitable for withdrawal through the mud evacuation line 28. The fluidized mud is admitted, under the difference of pressure between the interior of the conduit 28 and exterior thereof, into the conduit 28 and moves upwardly through the top portion 32 and outside of the conduit 28 through the opening 34. At least part of the evacuated mud is returned back into the pile 22, but this time it deposits itself on top of the annular plate 60 of the explosive assembly 16, since the diameter of the plate 60 is greater than the diameter of the carrier 12. The additional weight of the mud settled on the to of the plate 60 further assists in downward movement of the apparatus 10 downwardly through the depth of the pile 22.

The sparging assembly 14 continues to agitate the mud and ease the way of the explosive assembly 16 downwardly below the mud line to a predetermined depth. The depth of the position of the explosive device 16 can be easily determined by conventional depth control logs or by the length of the line being played out while lowering the apparatus 10 into the pile 22.

The explosive assembly 16, immediately following and moving simultaneously with the sparging assembly 14, reaches the pre-selected depth at a considerably shorter time as is possible with conventional devices and methods.

Once the desired depth is reached, the air pressure within the second air line 42 is regulated to move pneumatic pins 46 and 48 inwardly, releasing them from the engagement with the suspension plates 82 and 84. The explosive device 16 is left within the pile 22, while the sparging assembly 14 is moved upwardly through the annulus formed by the interior opening 65 of the assembly 16, carrying with it the carrier 12. In such a manner, the explosive device 16 is left to communicate with the surface only through the detonation cord 80. An electrical signal is transmitted through the detonating cord 80 to the explosive charge of the explosive assembly 16, detonating the explosive and causing severing of the pile 22 well below the mud line, at the required depth.

The upper part of the severed piling is removed from the location of the explosion by conventional methods, while the remainder of the piling stays embedded in the ocean floor but does not inhibit navigation in that area.

In the alternative, the pneumatic pins 46 and 48 can be substituted by other spring operated means and the carrier 12 may be retained within the piling and allowed to disintegrate along with the explosive assembly 16. The added weight of the silt deposited on the top of the plate 60 serves a secondary purpose of retaining the explosion force within the pile 22, without any adverse affects to the marine life and environment around the piling during severing operation.

Many changes and modifications can be made within the design of the present invention without departing from the spirit thereof. I therefore pray that my rights to the present invention be limited only by the scope of the appended claims.

I claim:

1. An apparatus for severing tubular members, comprising:

a cylindrical carrier;

a sparging assembly carried by said carrier for removing a debris accumulated within said tubular member; and an explosive assembly detachably mounted on said carrier adjacent a lower portion of said carrier for explosively severing the tubular member, said explosive assembly comprising a frame carrying an explosive material, said frame having an upper part provided with means for mounting the explosive assembly on the lower portion of the carrier, and a lower part, which extends to a level adjacent a lower portion of the sparging assembly, wherein said frame comprises a top annular compression plate and a bottom annular deflection plate, a top annular deflection plate and a bottom annular deflection plate, the top compression and deflection plates being held in relative parallel relationship to each other by a plurality of equidistantly peripherally mounted spacer bars.

2. The apparatus of claim 1, further comprising a ring-shaped sleeve fixedly attached between said top and said bottom deflection plates in substantially perpendicular relationship thereto and adjacent inner edges of the deflection plates.

3. The apparatus of claim 2, wherein a plurality of angularly oriented spacer bars define the lower part of the frame.

4. The apparatus of claim 1, wherein the explosive material is positioned between said top and bottom deflection plates in surrounding relationship to said sleeve.

5. The apparatus of claim 1, further comprising a pair of suspension plate means for releasably suspending the explosive assembly from the lower portion of the carrier, said suspension plate means being fixedly attached to and extending upwardly from said top compression plate.

6. An apparatus for severing tubular members, comprising:

a substantially cylindrical carrier having a central opening extending through the entire length thereof;

a sparging assembly carried by said carrier for removing a debris accumulated within said tubular member, said sparging assembly extending, at least in part, through the central opening of the tubular member, with a lower part of the sparging assembly extending below a lower portion of the tubular member, said sparging assembly comprising a sparging conduit means for delivery of water under pressure to an interior of the tubular member for dislodging and agitating the debris accumulated in the tubular member, said sparging conduit means having a sparging nozzle at a lower end thereof, said sparging assembly further comprising a debris evacuation conduit means for removing the dislodged debris from a level of the sparging nozzle and carrying the debris to a level adjacent an upper end of the tubular member;

an explosive assembly detachably mounted on the lower portion of said tubular member for explosively severing the tubular member, said explosive assembly comprising a frame carrying an explosive material, said frame having an upper part, provided with means for mounting the explosive assembly on the lower portion of the tubular member, and a lower part which extends to a level adjacent to the lower portion of the sparging assembly; and means for detachably securing the explosive assembly in engagement with said carrier.

7. The apparatus of claim 6, wherein said debris evacuation conduit means comprises means for creating a pressure differential between interior of the debris evacuation conduit means and exterior thereof.

8. The apparatus of claim 7, wherein said means for creating a pressure differential comprise a pressurized gas conduit mounted, at least in part, within said debris evacuation conduit means and having an outlet inside the debris evacuation conduit means.

9. The apparatus of claim 6, wherein said means for detachably securing the explosive assembly comprise a compression means mounted in the lower portion of the carrier and movable between a first, expanded position supporting said explosive assembly, and a second, retracted position releasing said explosive assembly from engagement with said carrier.

10. The apparatus of claim 9, said means for detachably securing the explosive assembly comprise pneumatically-operated securing pins.

11. The apparatus of claim 6, wherein said frame comprises a top annular compression plate and a bottom annular compression plate, a top annular deflection plate and a bottom annular deflection plate, the top compression plate and the top defection plate being held in relative parallel relationship to each other by a plurality of equidistantly peripherally mounted spacer bars.

12. The apparatus of claim 11, wherein said frame is formed with a central opening therethrough, said frame central opening being in substantial co-alignment with the central opening of the tubular member.

13. The apparatus of claim 12, lower part of the sparging assembly extends through the central opening of the frame.

14. The apparatus of claim 13, further comprising a ringshaped sleeve fixedly attached between said top and said bottom deflection plates in substantially perpendicular relationship thereto and adjacent inner edges of the top and bottom deflection plates.

15. The apparatus of claim 14, wherein the explosive material is positioned between said top and said bottom deflection plates in surrounding relationship to said sleeve.

16. The apparatus of claim 15, further comprising a pair of suspension plate means for releasably suspending the explosive assembly from the lower portion of the carrier, said suspension plate means being fixedly attached to and extending upwardly from said top compression plate.

17. The apparatus of claim 16, wherein said top compression plate has a diameter greater than a diameter of said tubular member.

18. The apparatus of claim 1, wherein said sparging assembly comprises:

a sparging conduit means for delivery of water under pressure to an interior of the tubular member for dislodging and agitating the debris accumulated in the tubular member, said sparging conduit means having a sparging nozzle at a lower end thereof; and a debris evacuation conduit means for removing the dislodged debris from a level of the sparging nozzle and carrying the debris to a level adjacent an upper end of the carrier, said debris evacuation conduit means comprising an inlet end and outlet end.

* * * * *